US006640608B2

(12) United States Patent
Pepper et al.

(10) Patent No.: US 6,640,608 B2
(45) Date of Patent: Nov. 4, 2003

(54) DUCTED SMOKE OR FIRE DETECTOR TESTING TOOL

(75) Inventors: Stewart Pepper, Herts (GB); Eddie Ozaki-Owen, Herts (GB)

(73) Assignee: No Climb Products Limited, Barnet (GB)

( * ) Notice: Subject to any disclaimer, the term of this patent is extended or adjusted under 35 U.S.C. 154(b) by 0 days.

(21) Appl. No.: 10/019,443

(22) PCT Filed: Apr. 24, 2001

(86) PCT No.: PCT/GB01/01819

§ 371 (c)(1),
(2), (4) Date: Apr. 9, 2002

(87) PCT Pub. No.: WO01/84520

PCT Pub. Date: Nov. 8, 2001

(65) Prior Publication Data

US 2002/0134131 A1 Sep. 26, 2002

(30) Foreign Application Priority Data

May 2, 2000 (GB) ..... 0010558

(51) Int. Cl.[7] ..... G08B 17/10

(52) U.S. Cl. ..... 73/1.02; 340/514; 340/515; 340/628; 340/630

(58) Field of Search ..... 73/1.02, 25.01, 73/23.31, 31.03; 250/222.1, 239, 215, 551.4; 340/514, 515, 520, 628, 630; 356/4.62, 375, 439, 440

(56) References Cited

U.S. PATENT DOCUMENTS

| | | | | | |
|---|---|---|---|---|---|
| 3,693,401 | A | * | 9/1972 | Purt et al. | 73/1.05 |
| 4,462,244 | A | * | 7/1984 | Lee | 73/1.05 |
| 5,170,148 | A | * | 12/1992 | Duggan et al. | 340/515 |
| 5,523,744 | A | * | 6/1996 | Wieser | 340/630 |
| 5,670,946 | A | | 9/1997 | Ellwood et al. | 340/628 |
| 6,015,230 | A | * | 1/2000 | Wantz et al. | 374/1 |
| 6,423,962 | B1 | * | 7/2002 | Pepper | 250/222.1 |

FOREIGN PATENT DOCUMENTS

| | | | | |
|---|---|---|---|---|
| DE | 3013599 A | * | 12/1980 | G08B/17/00 |
| EP | 0 910 055 | | 4/1999 | |
| EP | 971329 A1 | * | 1/2000 | G08B/29/14 |
| FR | 2 457 527 | | 12/1980 | |

* cited by examiner

*Primary Examiner*—Hezron Williams
*Assistant Examiner*—David Rogers
(74) *Attorney, Agent, or Firm*—Oblon, Spivak, McClelland, Maier & Neustadt, P.C.

(57) ABSTRACT

An apparatus for testing a smoking or fire detector includes an open-topped housing for receiving a detector under test. A stream of fluid for activating the detector is generated in a portion of the housing below the detector and is directed by a duct up one side of the interior of the housing to flow across the housing in a direction of the detector. A spacer can be provided in order to ensure that the direction of flow is precisely located at a point that is a predetermined distance above the bottom of the detector. Also, a heating element may be provided in the duct if required.

4 Claims, 1 Drawing Sheet

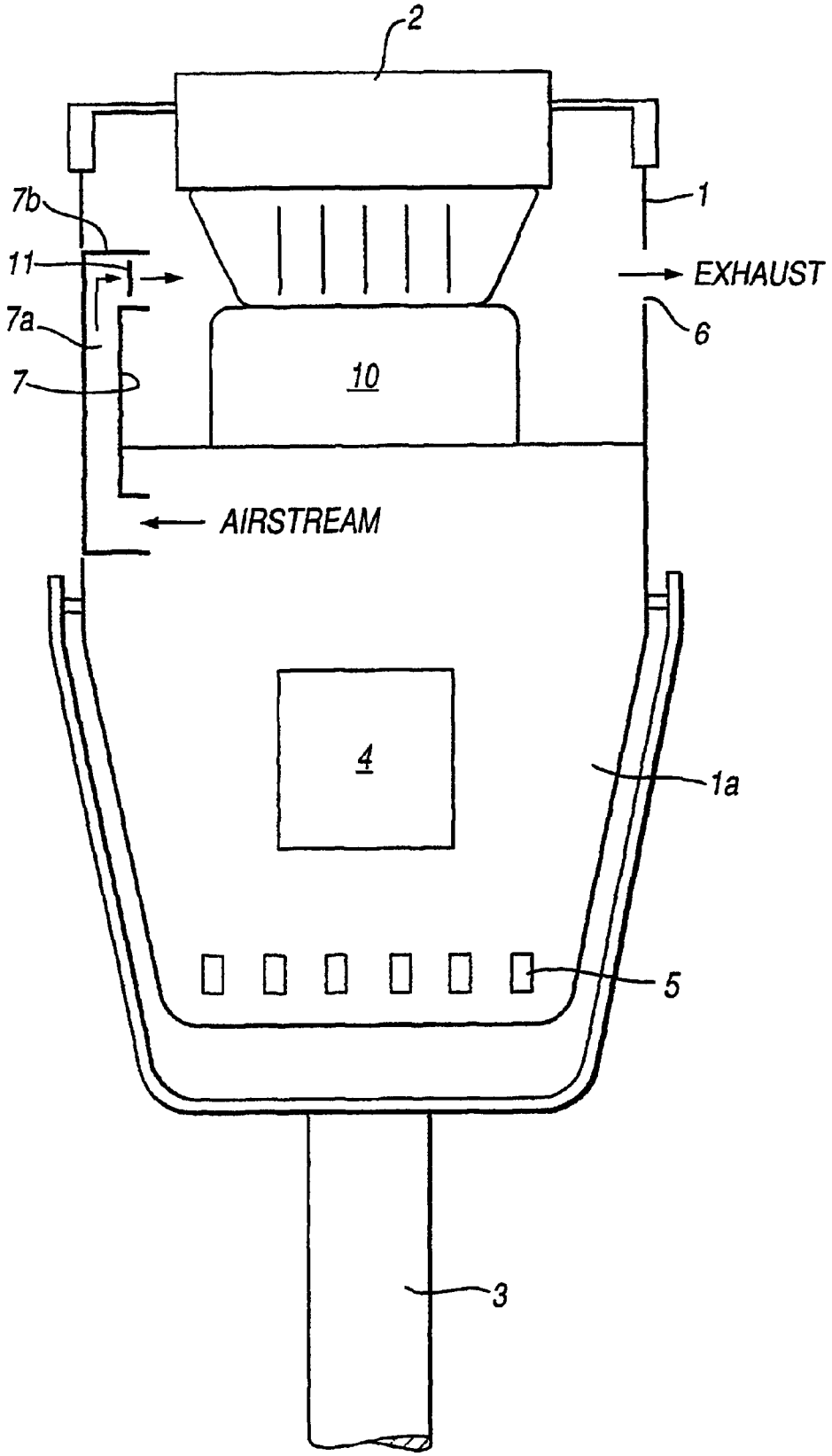
2
1
7b
11
EXHAUST
7a
6
7
10
AIRSTREAM
4
1a
5
3

DUCTED SMOKE OR FIRE DETECTOR TESTING TOOL

The present invention relates to a test tool, used for the testing of detectors and more particularly fire or smoke detectors.

Detectors are designed to detect substances which are carried in the air, or changes to the air passing through its vents/openings, for example. In fire protection, a heat detector which detects the rise in temperature of the air (and smoke) which passes through it while other detectors may sense products of combustion present in the air such as smoke. The air is normally expected to flow laterally through the vents of the device, and hence the vents are made open to the sides. Such devices are commonly mounted on ceilings to detect fires, since the heat, smoke and gases from a fire will rise to the ceiling and then move along it, due to convection currents entering the detector from the side.

Testing detectors which are mounted on ceilings (without removing them) is often achieved from the ground beneath the detector using access poles and special equipment. This naturally means that the approach is likely to be from the underside of the detector. To introduce a stimulus into the detector from underneath is not in keeping with the design of the detector, which is best suited to laterally-introduced stimuli.

The present invention provides an arrangement whereby the introduction of a stimulus into the detector under test is lateral, even though the tool may be accessing from beneath.

In a preferred embodiment, a stream of air which carries the stimulus for the detector is generated in the tool and ducted in such a fashion that it flows transversely across a cup, which itself is placed over the detector. The cup is preferably made from transparent material so that the detector may be seen during the test, since often an LED is mounted on the detector, which indicates when an alarm status has been reached.

In order that the present invention be more readily understood, an embodiment thereof will now be described by way of example with reference to the accompanying drawing, which shows a diagrammatic side view of a test tool according the present invention.

The preferred embodiment of the present invention will be described in relation to its use as an in-situ test tool fitted on to the end of pole and generally constructed as described in EP-A-09 10055 the contents of which are incorporated herein by reference. The tool which comprises a cup-shaped housing 1 arranged to surround a detector 2 under test and fixed to the end of a pole 3. The improvement which is embodied in the present invention is that the stimulus and airflow are ducted up one side of the cup so as to flow laterally across it. To ensure that the diameter of the tool is kept to a minimum, thereby providing for good access to tight spaces for the tools the stimulus and airflow are generated by means located in the housing 1 in a portion 1 a of the cup below the portion arranged to receive the detector under test. It may be necessary to provide an air inlet 5 to the housing if a fan is required to generate the airstream from the generating means 4. In any event, the cup has an exhaust port 6 which allows the airstream to exit the housing 1. The exhausted air might be ducted back into the tool or left open to vent to the atmosphere.

The ducting of the airflow and stimulus is achieved by the interior of the portion of the cup arranged to receive the detector 2 under test being provided with a duct 7 which has a portion 7*a* which is parallel to the wall of the cup 1 and has a portion or aperture 7*b* arranged to direct the airflow or stimulus generally normal to the plane of the wall of the cup and thus across the cup. The duct 7 can be provided, if desired, with a nozzle or other constricting arrangement in order to direct the airflow in a precise direction.

The activation of some types of detector can be enhanced further by ensuring that the transverse flow of air is aimed and focussed onto the "sweet spot" of the detector's sensor. This technique can reduce the amount of stimulus required since it is aimed so directly at the sensing element. To do this, the location of the detector's "sweet spot" must be known.

In the case of heat detectors, the sensing element of the detector under test is often positioned nearer the lowest extreme of the detector casing from the ceiling. The actual distance of this sensing element from the ceiling may vary considerably (approx 20–80 mm), but the distance of the sensing element from the lowest point of the detector is relatively constant, (approx 0 to 20 mm). This geometry can be used to advantage when aiming and focussing the stream of air. Within the cup, a spacer 10 is used, which contacts the underside of the detector 2 when the cup 1 is positioned over the detector. This forms a reference from which the direction of the airstream from the duct 7 is positioned. With the lower part of the detector resting on this spacer 10, and the airstream is arranged to flow across the cup just above this support, the heat detector's sensing element is well positioned to be in the line of this movement of air. The stimulus required for the heat detector can then be applied to the air in the knowledge that the sensing element is going to be targeted.

If the testing tool is battery powered it is desirable that the power in the battery is conserved as much as possible in order to extend the periods of use between battery replacement or recharging. To achieve this, the application of a heat stimulus to the airstream is best achieved using a heating element 11 which is sited at the top of the duct 7 which carries the airflow into the cup. This way, none of the heat from the element 11 is used to heat the duct, but it is efficiently targeted towards the sensing element of the detector 2 under test only.

Also, since the flow or air can also be directed and narrowed by use of the duct, the amount of heated air which is required can be reduced, thereby further increasing the longevity of the battery in the tool. It is not required that the ambient air in the cup is heated to the required temperature for the detector under test, merely that the detector's sensing element is heated to the required temperature. Hence a lot of energy is saved in not heating up so much air and other surroundings (eg the casing of the detector, the casing of the tool) which are in contact with the air.

The same principles which have been applied to the testing of heat detectors in the above can also be applied to other types of detectors. The type of stimulus and the detail of ensuring that the stimulus is applied in the most efficient manner to the actual sensing element may vary. Other detectors which are used to detect fires include smoke and gas detectors. The stimuli required in these instances must be perceived by the detector to be like that of the fires that are intended to detect. The transverse flow of air across the cup will be similar, since the detectors are designed to accept air through lateral vents.

The design of a tool as described above may incorporate one or more of the features from the above-mentioned EP-A-0910055 eg Battery Batons, within the access pole, non-contact infrared sensors on the cup, combinational hinge/electrical connection, sealing membrane at top of cup. In some circumstances, because of the highly directional nature of the directed stimulus and airflow, it is not necessary to seal the top or open end of the cup to the ceiling.

What is claimed is:

1. Apparatus for testing a detector comprising:

an open-topped housing including a bottom and side wall for receiving a detector under test, means for generating a stream of fluid for stimulating the detector under test, and a duct configured to receive the stream of fluid, the duct including a first portion located on one side of the housing generally parallel to the side wall of the housing and a second portion at an angle to the first portion and configured to direct the stream of fluid across the housing and towards the detector under test.

2. Apparatus according to claim 1, further comprising means in the housing for abutting the detector under test, the second portion of the duct being spaced a preset distance from the abutment means so as to direct the fluid flow from the second portion of the duct into the detector under test.

3. Apparatus according to claim 1, wherein a heating element is located in the second portion of the duct and is configured to heat the stream of fluid.

4. Apparatus according to claim 1, wherein the housing is provided with means for allowing the fluid introduced into the housing to exit.

* * * * *